US005779089A

United States Patent [19]

West

[11] Patent Number: 5,779,089

[45] Date of Patent: Jul. 14, 1998

[54] CRYOGENIC STORAGE APPARATUS WITH LID VENT

[75] Inventor: William West, Marietta, Ohio

[73] Assignee: Forma Scientific, Inc., Marietta, Ohio

[21] Appl. No.: 686,657

[22] Filed: Jul. 26, 1996

[51] Int. Cl.[6] ..... B65D 51/16

[52] U.S. Cl. ..... 220/367.1; 220/203.16; 220/203.11

[58] Field of Search ..... 220/203.11, 203.15, 220/203.16, 203.29, 901, 366.1, 367.1, 373, 374

[56] References Cited

U.S. PATENT DOCUMENTS

| | | | |
|---|---|---|---|
| 2,889,953 | 6/1959 | Morrison | 220/901 |
| 3,039,418 | 6/1962 | Versluis . | |
| 3,093,260 | 6/1963 | Macormack et al. . | |
| 3,110,156 | 11/1963 | Niemann | 220/901 |
| 3,272,579 | 9/1966 | Leonard . | |
| 3,883,030 | 5/1975 | Mathews et al. | 220/203.16 |
| 4,116,199 | 9/1978 | Bryne | 220/901 |
| 4,228,662 | 10/1980 | Klipping . | |
| 4,344,291 | 8/1982 | Tyree, Jr. et al. . | |
| 4,474,015 | 10/1984 | Christmas et al. . | |
| 4,490,982 | 1/1985 | Christmas . | |
| 4,548,335 | 10/1985 | Remes et al. . | |
| 4,715,186 | 12/1987 | Ishimaru et al. . | |
| 4,739,622 | 4/1988 | Smith . | |
| 4,790,445 | 12/1988 | Shibata | 220/374 |
| 4,882,821 | 11/1989 | Sims, Jr. | 220/344 |
| 4,956,156 | 9/1990 | Kanner et al. | 220/373 |
| 4,958,498 | 9/1990 | Brothers . | |
| 4,976,112 | 12/1990 | Roberts et al. . | |
| 5,135,012 | 8/1992 | Kamen et al. | 220/230 |
| 5,168,725 | 12/1992 | Margolin . | |
| 5,404,918 | 4/1995 | Gustafson . | |
| 5,421,161 | 6/1995 | Gustafson . | |

*Primary Examiner*—Stephen J. Castellano
*Attorney, Agent, or Firm*—Wood, Herron & Evans L.L.P.

[57] ABSTRACT

A cryogenic storage apparatus including housing, inner storage tank which may contain cryogenic fluid such as liquid nitrogen, and a lid which is used to access the storage tank. The lid preferably completely seals the storage tank when in a closed position, and includes a vent path formed between the storage tank and ambient. This vent path leads to the rear of the housing. A flap valve is mounted to the exit point of the vent path to allow escape of evaporated liquid nitrogen as necessary.

11 Claims, 2 Drawing Sheets

CRYOGENIC STORAGE APPARATUS WITH LID VENT

BACKGROUND OF THE INVENTION

This invention generally relates to cryogenic storage apparatus and, more specifically, to a unique and advantageous venting system employed in the lid or closure member of the apparatus.

Many types of cryogenic storage units exist for various scientific or industrial purposes. These units rely on methods of refrigeration that allow items to be cooled often below 100° C. For some of coldest storage applications, liquid cryogen, such as nitrogen, is contained within a tank and the items to be stored or otherwise treated are simply immersed in this bath of liquid cryogen.

As liquid cryogens generally evaporate at ambient temperatures and pressures, there should be a venting system employed in these units. Otherwise, the units must be manufactured as pressure vessels and, in such situations, access to any items stored within the units would be limited and difficult. Typically, the venting systems employed in top opening units used, for example, to store scientific samples and other accessible items have involved peripheral venting about the upper lid of the unit. This peripheral venting involves using discontinuous seals about the periphery of the lid. That is, vents are provided generally between the lid and the housing of the unit at spaced peripheral regions around the unit.

Unfortunately, the peripheral venting around the unit has led to various disadvantages and ill effects. For example, frost and ice build up on the outside of the unit adjacent to the vents when the cold gas meets humid ambient air. These vents may also lead to the escape of more liquid cryogen from the storage tank than is necessary to allow for gas expansion within the tank. Thus, depletion of the liquid cryogen through evaporation may occur more rapidly than necessary.

With this background in mind, it would be desirable to provide a cryogenic, liquid cryogen storage apparatus having a venting system which better inhibits the formation of frost or ice around the periphery of the lid and housing and which also more readily regulates the escape cryogen gas.

SUMMARY OF THE INVENTION

To these ends, the present invention is generally embodied in a cryogenic storage apparatus having a housing and a cryogenic storage chamber mounted within the housing. The focus of this invention is on a vented lid which is connected to the housing to selectively expose an opening to the storage chamber and allow access to stored or treated items contained within that chamber. At least one peripheral seal is disposed generally between an open end of the storage chamber and the lid. The seal at least substantially surrounds the open end of the storage chamber and may or may not be located directly at the opening of the chamber. In accordance with the invention, a vent path is formed within the lid and leads from the cryogenic storage chamber to ambient.

Preferably, two separate seals are used with one being a continuous, magnetic seal disposed between the housing and one side of the lid and the other being a continuous seal around an upper rim of the storage chamber. The lid includes a central section and a peripheral section and the vent is preferably formed through the central section, opening to the storage chamber, and ultimately through the peripheral section to ambient. Most preferably, the vent opens to ambient at the rear of the lid and away from the user needing to access and possibly control the unit at the front side. The lid is thermally insulated and the central section extends downwardly from the peripheral section such that it extends into the storage chamber when the lid is in a closed position.

In the preferred embodiment, a valve is operatively connected with the vent path for controlling gas flow through the vent path. This valve may simply be a hinged flap valve connected at the rear of the lid to selectively expose the opening of the vent at that location and to allow venting of gas as necessary. The valve is designed to be normally closed and opens as necessary to vent the evaporating and expanding gas within the storage tank.

DETAILED DESCRIPTION OF THE PREFERRED EMBODIMENT

Figure 1:
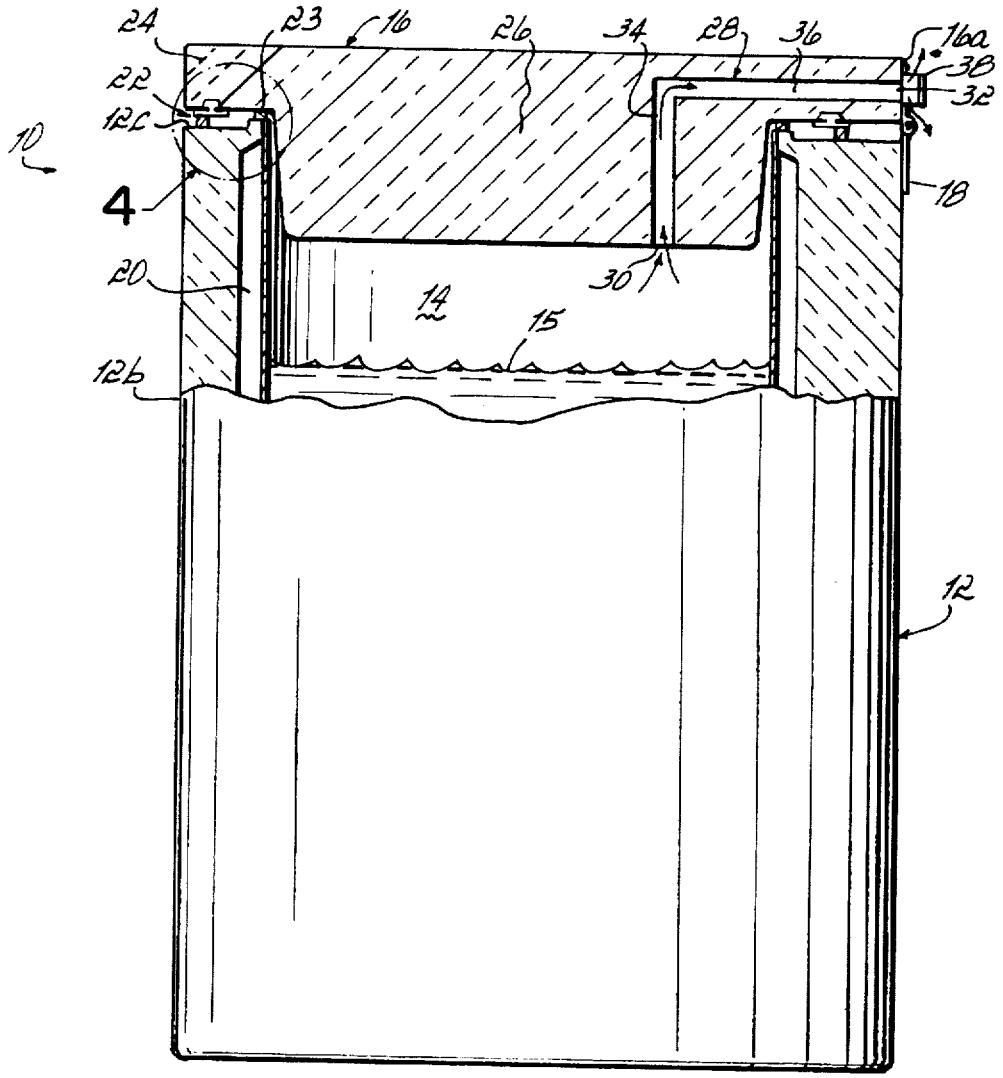
FIG. 1 is a side elevational view of a cryogenic storage apparatus constructed in accordance with this invention and partially illustrated in section to show various details.

FIG. 1 illustrates a cryogenic storage apparatus 10 constructed in accordance with a preferred embodiment of this invention. Apparatus 10 generally comprises a housing 12 formed with an inner layer of thermally insulating material which is suitable for cryogenic applications of the type employing liquid cryogen, such as nitrogen, at temperatures less than about −100° C. A storage tank 14 is mounted within housing 12 and holds a desired level of, for example, liquid nitrogen 15. Liquid nitrogen 15 is the preferred cryogenic substance used to store or treat items within storage tank 14, however, the invention is not limited to this particular liquid.

Figure 2:
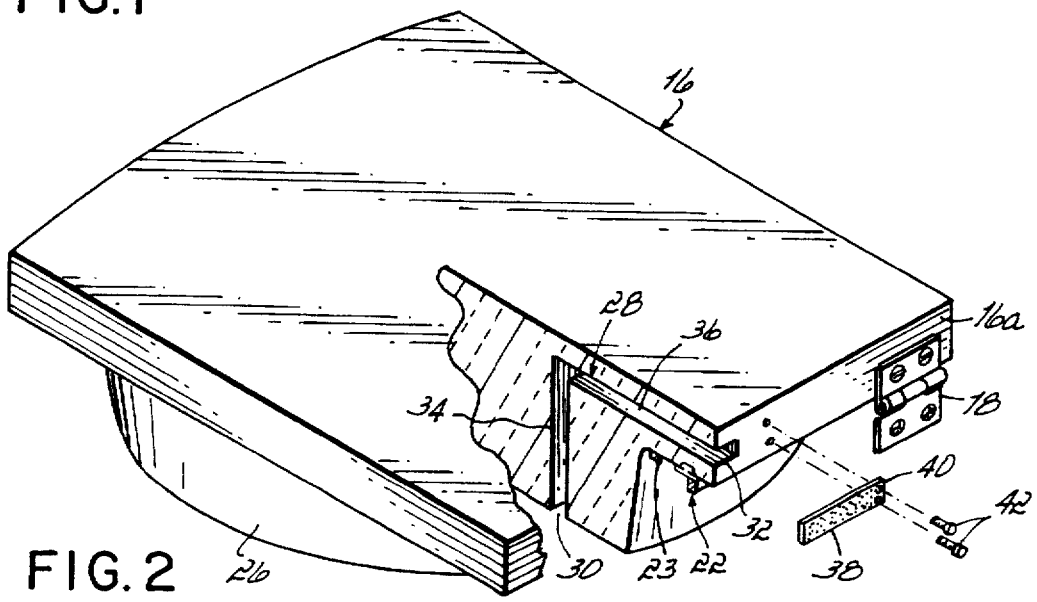
FIG. 2 is a perspective view of the lid partially fragmented to show the vent path and showing an exploded view of the valve associated with the vent path.
Figure 3:
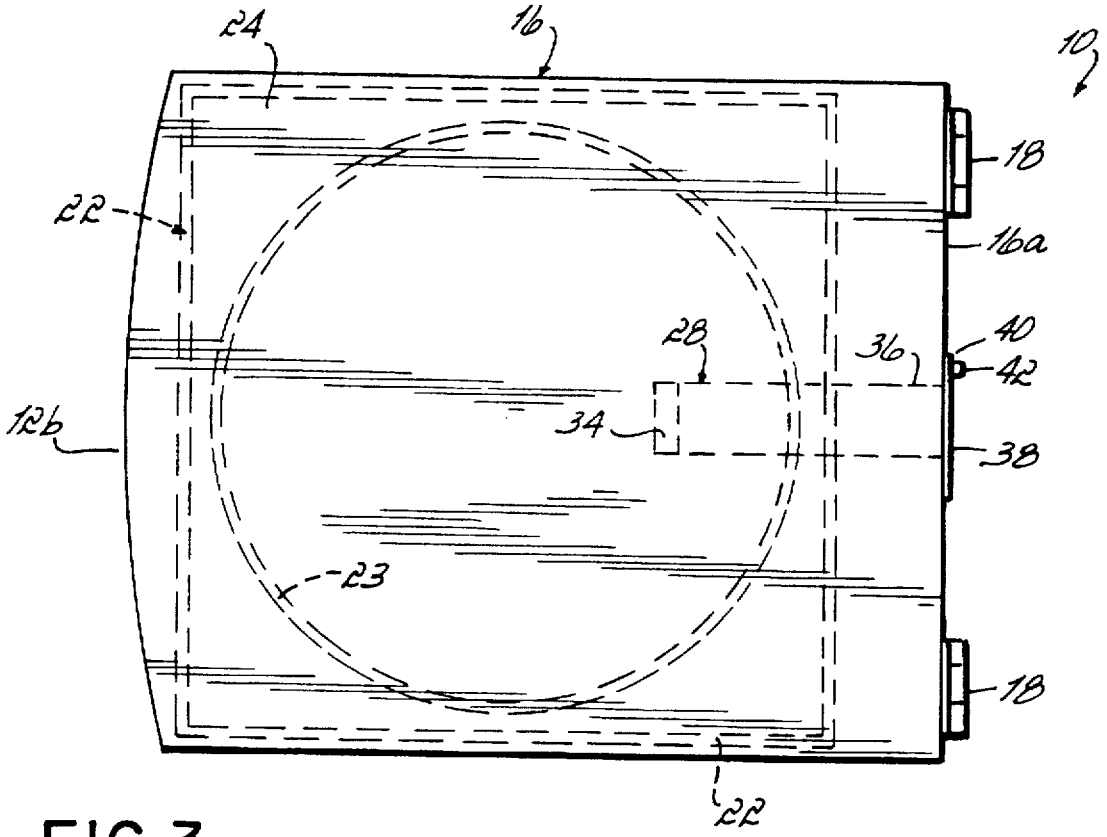
FIG. 3 is a top view of the lid showing the vent and seal thereof.

A lid 16, constructed in accordance with this invention, is shown in FIGS. 1–3. Lid 16 is connected by at least one hinge 18 at the rear edge **16*a* of lid 16 and housing 12. This allows lid 16 to be opened upwardly and accessed from the front side 12*b* of housing 12. A thermally insulative space 20, substantially under vacuum, is left between housing 12 and storage tank 14**, as is conventional.

Figure 4:
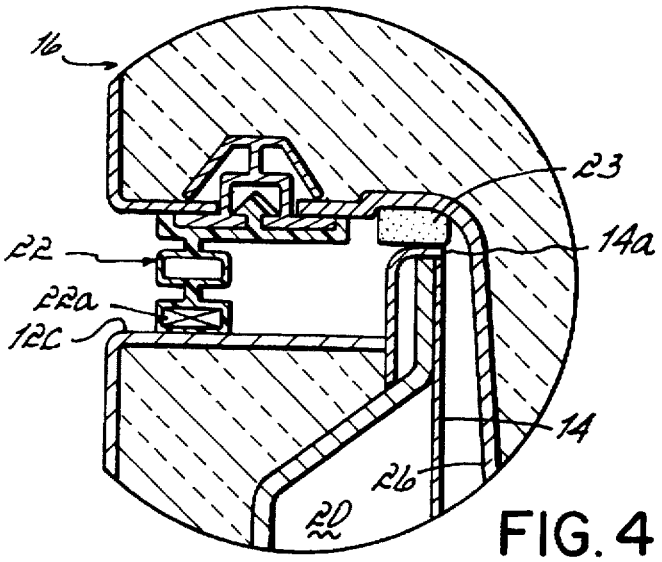
FIG. 4 is an enlarged view of the encircled portion 4 of FIG. 1.

As best shown in FIG. 4, a seal 22, preferably of the magnetic gasket type used on typical refrigerator doors, is disposed between a lower side of lid 16 and an upper side of housing 12. Another seal 23, preferably formed of silicone sponge material, is disposed between the lower side of lid 16 and an upper rim **14*a* of tank 14. Seals 22, 23 are preferably continuous, but may be substantially continuous. There maybe discontinuities, for example, in the rear sides of seals 22, 23 while still realizing benefits from the invention. Preferably, seal 22 are rigidly affixed to a peripheral section 24 of lid 16 and engages a flat upper metal surface 12*c* of housing 12 in the closed position as shown in FIG. 1. A magnet 22*a* associated with seal 22 holds seal 22 against surface 12*c*. Seal 23 is preferably adhered to the underside of peripheral section 24 and is held against rim 14*a* in the closed position partially aided by the magnetic attraction between seal 22 and surface 12*c*. Lid 16 further includes a central section 26, also formed of a thermally insulative material, extending downwardly from peripheral section 24. Central section 26 therefore extends downwardly into storage tank 14**.

In accordance with the invention, and also as shown in FIGS. 1–3, lid 16 includes a vent 28 leading generally from the inside of storage tank 14 to ambient when lid 16 is in a closed position. Vent 28 is a bore extending upwardly through lid 16 and, more specifically, includes an entry point 30 disposed in central section 26 and an exit point 32 in peripheral section 24. The exit point could be in the top of central section 26 as an alternative. However, this may be undesirable in certain applications. In the preferred embodiment, vent 28 includes an upwardly extending section 34 within central section 26 and a sidewardly extending section 36 extending through peripheral section 24 of lid 16. As also shown in FIGS. 1 and 2, lid 16 includes a flap valve 38 connected by a flexible or hinged portion 40 using fasteners 42. Flap valve 38 is normally disposed against exit point 32 to close vent 28 but may pivot to an open position, as shown in FIG. 1, as necessary to allow the escape of evaporated gases from within storage tank 14.

Although a preferred embodiment of this invention has been detailed hereinabove, those of ordinary skill will recognize many substitutions and modifications that still fall within the spirit and scope of the inventive concepts. Therefore, Applicant intends to be bound only by the legal scope of the appended claims.

What is claimed is:

1. A cryogenic storage apparatus comprising:

a housing;

a cryogenic storage chamber contained within said housing and having an open end;

a lid connected to said housing and operable to selectively expose the open end of said cryogenic storage chamber;

a seal at least substantially surrounding the open end of said storage chamber and engageable with said lid; and, a vent path formed within said lid and leading from said cryogenic storage chamber to ambient when said lid is in a closed position, said vent path including a flap valve mounted at a rear portion of said lid for controlling gas flow through said vent path.

2. The cryogenic storage apparatus of claim 1 wherein said lid and said housing include respective front and rear sides and said vent path opens to the rear side of said lid.

3. The cryogenic storage apparatus of claim 1 wherein the seal extends around a periphery of said opening and between an upper surface of said housing and a lower surface of said lid.

4. The cryogenic storage apparatus of claim 1 wherein said storage chamber is contained in a storage tank mounted within said housing, said housing further includes a thermally insulated outer section and a space maintained under vacuum disposed between said outer section and said storage tank.

5. The cryogenic storage apparatus of claim 1 wherein the storage chamber is formed by a tank having a rim and the seal is engageable with the rim of said tank.

6. The cryogenic storage apparatus of claim 1 wherein the storage chamber is formed by a tank having a rim and the seal is engageable with said housing a distance spaced outwardly from said rim.

7. The cryogenic storage apparatus of claim 6 wherein said seal is a magnetic gasket.

8. A cryogenic storage apparatus comprising:

a housing;

a cryogenic storage chamber contained within said housing and having an open end;

a lid connected to said housing and operable to selectively expose the open end of said cryogenic storage chamber;

a seal at least substantially surrounding the open end of said storage chamber and engageable with said lid;

a vent path formed within paid lid and leading from said cryogenic storage chamber to ambient when said lid is in a closed position;

wherein said lid is mounted on a top side of said housing and includes a peripheral portion contacting the seal and a central portion extending downwardly into said storage chamber, said vent path extending through both said central portion and said peripheral portion.

9. The cryogenic storage apparatus of claim 8 wherein said lid is thermally insulated.

10. A cryogenic storage apparatus comprising:

a housing;

a cryogenic storage chamber contained within said housing and having an open end;

a lid connected to said housing and operable to selectively expose the open end of said cryogenic storage chamber;

a seal at least substantially surrounding the open end of said storage chamber and engageable with said lid;

a vent path formed within said lid and leading from said cryogenic storage chamber to ambient when said lid is in a closed position;

wherein the storage chamber is formed by a tank having a rim with the seal being engageable with said rim, and further comprising a second seal engageable with said housing a distance spaced outwardly from said rim.

11. The cryogenic storage apparatus of claim 10 wherein the second seal is a magnetic gasket.

* * * * *